US005648004A

United States Patent [19]

Simpson

[11] Patent Number: 5,648,004

[45] Date of Patent: Jul. 15, 1997

[54] KIT AND METHOD TO RETROFIT HEATING ELEMENTS FOR CURLING IRON HOLDER

[76] Inventor: Claudie Simpson, 423 Mahota Dr., San Antonio, Tex. 78227

[21] Appl. No.: 634,851

[22] Filed: Apr. 19, 1996

[51] Int. Cl.[6] ..... A45D 1/20; H05B 1/02

[52] U.S. Cl. ..... 219/242; 219/222; 219/521; 132/229; 439/485; 439/207; 439/542

[58] Field of Search ..... 219/242, 222, 219/227, 229, 521, 385; 439/207, 485–487, 542, 543, 576; 174/68.3; 228/51; 132/229, 232, 269, 271

[56] References Cited

U.S. PATENT DOCUMENTS 3,990,622 11/1976 Schurman, Jr. et al. ..... 219/242
4,013,873 3/1977 Olson ..... 174/68.3
4,418,268 11/1983 Munshaw ..... 219/242
5,048,742 9/1991 Fortune ..... 219/242
5,472,133 12/1995 Lin ..... 219/242

*Primary Examiner*—John A. Jeffery

[57] ABSTRACT

A kit and method is applied to industrial curling iron heating stations in order to extend their useful service lifetime. These stations, as normally manufactured, contain low temperature 120 VAC internal wiring which tends to crystallize and short out when subjected to daily use. The invention comprises a thermally conductive threaded tube attached to the heating station base, high temperature wires which replace the low temperature 120 VAC internal wiring of the station, and a 120 VAC socket which connects to the wires and is attached to the tube. The low temperature wiring is then connected to a retrofit 120 VAC plug, which mates with the retrofit 120 VAC socket. After the retrofit operation is complete, the station useful life is no longer limited by heat induced degradation of the low temperature 120 VAC wiring.

8 Claims, 4 Drawing Sheets

KIT AND METHOD TO RETROFIT HEATING ELEMENTS FOR CURLING IRON HOLDER

BACKGROUND OF THE INVENTION

1. Field of the Invention

The present invention relates to industrial curling iron heating stations used to maintain the temperature of hair curling or straightening irons as used in the cosmetic and beauty shop industry. More particularly, the present invention is directed toward a kit and method to refit an existing station to provide a longer service life for the 120 VAC internal wiring of the heating station.

2. Background Information

In beauty shops throughout the country, a curling iron heating station used to heat and assist in maintaining the temperature of hair curling or straightening irons is commonly used. This heating station consists of a base upon which is mounted a heating element. Common household current (120 VAC) is supplied to a resistive material which lines the interior of the heating element body so as to produce a zone of heated air within a hollow portion of the element. The 120 VAC wiring which makes the connection between the resistive material and the wall socket is contained in the base and consists of a continuous run of conventional low-temperature appliance cord, normally rated for continuous exposure to temperatures of 60° C. to 80° C. (140° F. to 176° F.). Typically, these curling iron heating stations are turned on at the beginning of a working day and not turned off again until the day is complete. As a result, the metal body of the element and the base get quite hot due to continuous heating of the element. The 120 VAC wiring proximate to the resistive heater material tends to crystalize and short out within approximately six months of daily use. This means that the curling iron heating station, which has a normal service life of two years, must be rewired at least three times during its useful life. This periodic breakdown results in both inconvenience and extra expense to the beauty shop operator.

SUMMARY OF THE INVENTION

It is an object of the present invention to provide a 120 VAC wiring retrofit kit which can be quickly and inexpensively applied to commonly available industrial grade curling iron heating stations for hair curling or straightening irons.

It is another object of the present invention to set forth a retrofit kit which can be applied to conventional curling iron heating stations, either before they are placed in service or after they have been in service for some time and failed due to destructive heating of the internal 120 VAC wiring.

It is yet another object of the present invention to provide a retrofit kit which consists of commonly available industrial components.

It is a further object of the present invention to provide a retrofit kit and method which results in a modified curling iron heating station which has an internal 120 VAC wiring service life roughly equivalent to the service life for the rest of the station.

In satisfaction of these and related objectives, the present invention provides a 120 VAC wiring retrofit kit and method which can be easily and inexpensively applied to conventional industrial grade curling iron heating stations at any point in their useful service lifetime. The resulting station, as modified, should require no service of the internal wiring due to heat degradation after the installation of the kit according to the method described herein.

DETAILED DESCRIPTION OF THE PREFERRED EMBODIMENT

Figure 1:
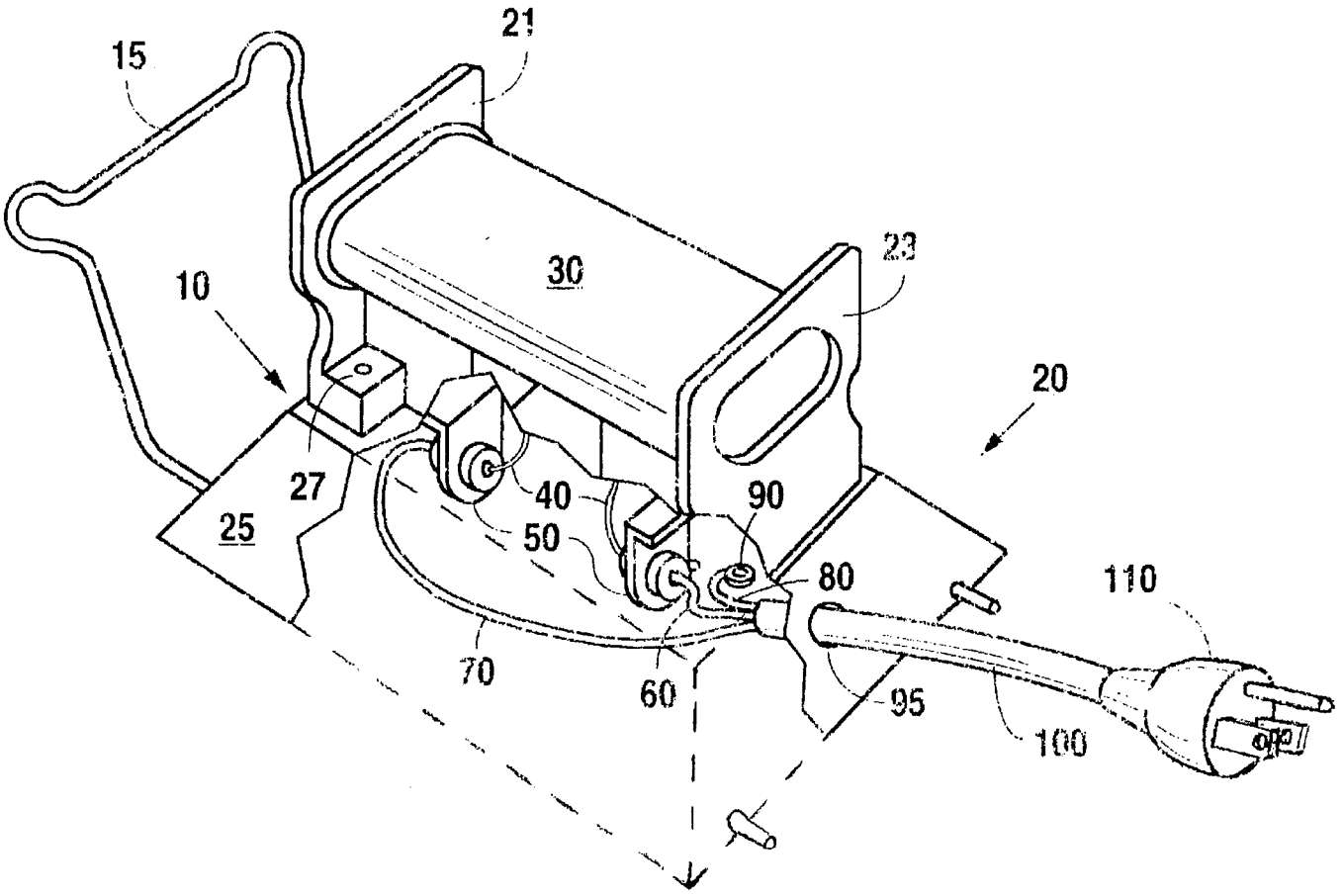
Fig. 1 (PRIOR ART)
FIG. 1 is a perspective cut-away view of a prior art curling iron heating station as manufactured.

Referring now to FIG. 1, a cut-away perspective view of a typical industrial grade curling iron heating station of the prior art is shown. Devices of this type are available from Lawndale Products, Inc. as Model Nos. S.H.1 and M.H.-3. Curling iron heating station 10 as shown generally in FIG. 1 is composed of two components, base 20 and heat reservoir 30. Heater coil 40 is made of resistive material such that, when 120 VAC is applied to it, heater coil 40 becomes red hot. Heater coil 40 is fabricated so as to surround the interior of heat reservoir 30 and thus provide an enclosed area of relatively high heat for the insertion of commonly used hair curling or straightening irons. These irons are not necessarily heated by conduction, but receive most of their heat input via convection and radiation from the interior walls of heat reservoir 30.

To provide the necessary 120 VAC current to heater coil 40, low temperature appliance cord 100 is typically used. The low temperature appliance cord 100 enters base 20 by way of base entry port 95 which usually consists of a simple hole in base 20. Low temperature appliance cord 100 typically carries three separate conducting elements: low temperature line wire 60, low temperature return wire 70, and low temperature ground wire 80. Low temperature line wire 60 is connected to one end of heater coil 40 by way of an insulated standoff 50. Low temperature return wire 70 is likewise is connected to the other end of heater coil 40 with another insulated standoff 50. Finally, low temperature ground wire is connected to base 20 using chassis ground terminal 90. A connection between the curling iron heating station 10 and 120 VAC current is effected using appliance wall plug 110, which is connected to the three conducting elements contained within low temperature appliance cord 100. Insulated standoffs 50, chassis ground terminal 90, and low temperature appliance cord 100 are all commonly available and well known to those skilled in the art.

During operation, curling iron heating station 10 as depicted in FIG. 1 tends to transfer much of the heat generated by heater coil 40 into base 20 by means of conduction between heat reservoir 30 and base 20. This is because heat reservoir 30 is typically mounted directly to base 20 by means of metal-to-metal contact, and the heat travels from heat reservoir 30 through left and right upstanding end members 21 and 23 to housing 25 of base 20 via mounting flange 27. As a result, the temperatures within base 20 can easily exceed the design temperature rating (typically 60° C. to 80° C.) of the low temperature appliance cord 100. Continuous exposure of low temperature appliance cord 100 to elevated temperatures within base 20 produces brittleness and early failure of the conducting elements contained within: low temperature line wire 60, low temperature return wire 70, and low temperature ground wire 80. Such failure is not only inconvenient and expensive for the beauty shop operator, but is also unsafe, because it is usually manifested by shorting between these conducting elements of low temperature appliance cord 100. When the failure occurs, curling iron heating station 10 is no longer usable until it can be rewired.

Figure 2:
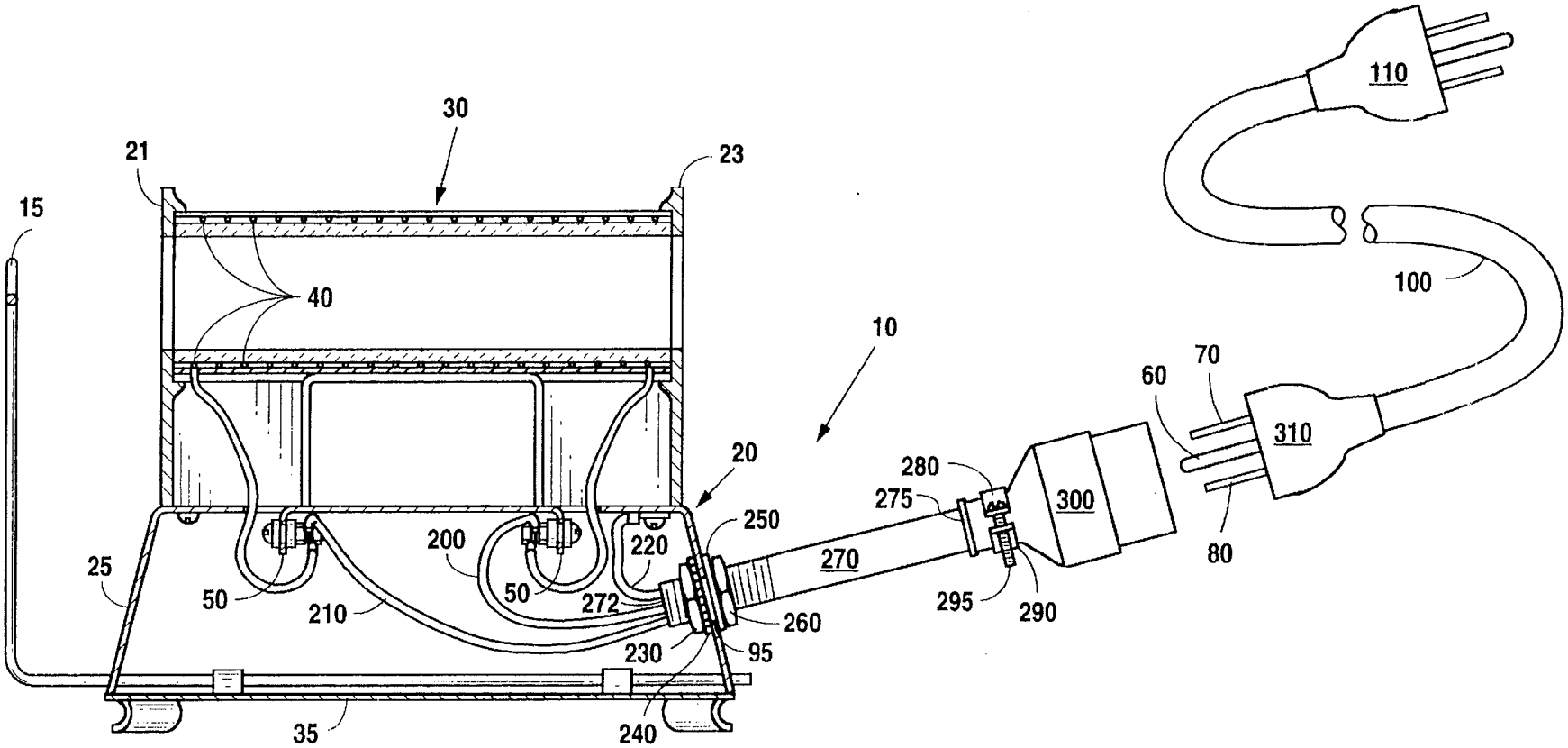
FIG. 2 is a side, partial cross-sectional view of the present invention as applied to retrofit the 120 VAC wiring in a conventional curling iron heating station.

Turning now to FIG. 2, a cross-sectional view of the present inventive kit, applied as a retrofit to the conventional curling iron heating station 10, can be seen. In essence, low temperature appliance cord 100 is removed from the interior of base 20 and replaced with high temperature conducting elements and a hollow threaded tubing radiation component, which serves to draw heat away from base 20 and radiate it to the surrounding environment.

Figure 3:
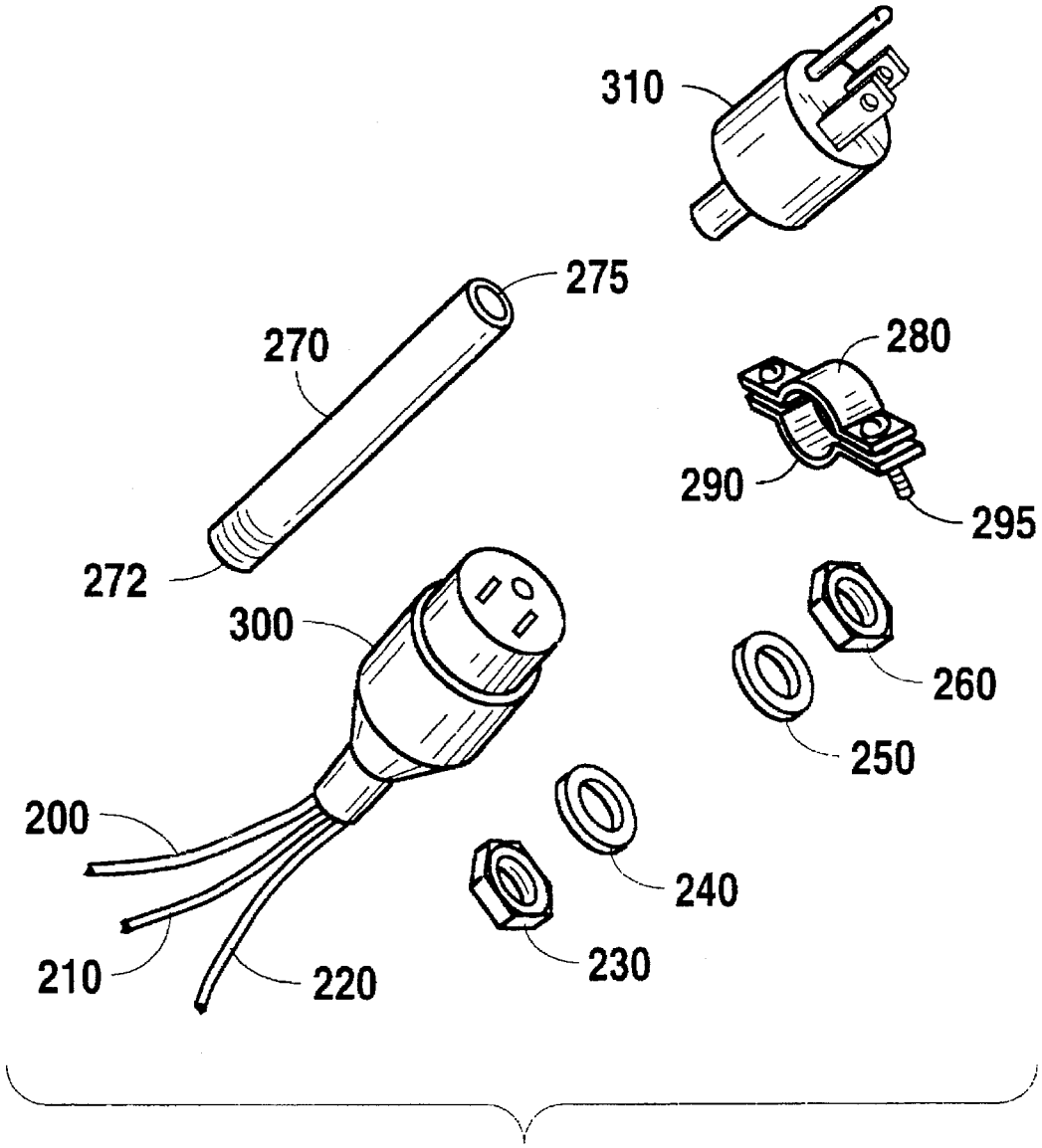
FIG. 3 illustrates the individual component parts of the present inventive retrofit kit.

Turning now to FIG. 3, the components of the present inventive kit can be seen. It is intended that the contents of this kit, along with a few simple hand tools, comprise the necessary elements to effectively retrofit a conventional curling iron heating station 10 as depicted in FIG. 1. Each of the elements is readily available from conventional hardware stores and/or electrical suppliers. Thermally conductive threaded tube 270 with proximal end 272 and distal end 275 may be of any suitable material which is mechanically rigid, thermally conductive, and threaded to accept inner and outer nuts 230 and 260. Inner and outer lock washers 240 and 250 are sized to accommodate the outer diameter of thermally conductive threaded tube 270. Appliance line socket 300 is fitted with suitable lengths of high temperature, insulated conductors (rated for approximately 200 degrees C., which may be coated with Teflon® or other suitable material); here designated as high temperature line wire 200, high temperature return wire 210, and high temperature ground wire 220. The wire gage within each conductor's insulation should be sized appropriately to the current drawn by heater coil 40. Appliance line plug 310 is selected so as to mate with appliance line socket 300, and should also be of an appropriate amperage rating, to accommodate the current drawn by heater coil 40. Mechanically, appliance line socket 300, upper socket wire clamp 280, lower socket wire clamp 290, and clamp screws 295 should be selected so as to accommodate the outer diameter of thermally conductive threaded tube 270. The tools required for effective application of the present inventive kit to a conventional curling iron heating station 10 are (1) a wrench fitted to accommodate inner and outer nuts 230 and 260; (2) a screwdriver(s) to accommodate clamp screws 295 and other screws which may be present within the body of appliance line socket 300 and appliance line plug 310, and also to fit standoffs 50, if necessary; (3) a wire cutter/stripper to effectively size and expose the conductors for low temperature line wire, return wire, and ground wire 60, 70 and 80 (respectively), and high temperature line wire, return wire, and ground wire 200, 210 and 210 (respectively); and (4) a soldering iron (if necessary) to disconnect the low temperature line wire, return wire, and ground wire 60, 70 and 80 (respectively) from curling iron heating station 10.

The retrofit procedure is as follows:

An existing curling iron heating station 10 is disassembled by disconnecting low temperature appliance cord 100 from insulated standoffs 50 and chassis ground terminal 90. Low temperature appliance cord 100 and insulated standoffs 50 can be accessed in this particular rendition of the preferred embodiment (FIG. 1) by simply removing retaining clamp 15 from base plate 35, so as to expose the interior of housing 25. Thermally conductive threaded tube 270 is inserted into base entry port 95 and sized so as to engage the base housing 25. Inner lock washer 240 and inner nut 230 are applied to the proximal end 272 of thermally conductive threaded tube 270 which has penetrated base entry port 95. Outer lock washer 250 and outer nut 260 are applied to the exterior of base 20 in a similar manner so as to mechanically support and affix thermally conductive threaded tube 270 to base 20. At this time, three conductors with high temperature insulation (rated for approximately 200° C.) are brought through the distal end 275 of thermally conductive threaded tube 270 and into the interior of base 20: high temperature line wire 200, high temperature return wire 210, and high temperature ground wire 220. High temperature line wire 200 is connected to one end of heater coil 40 at insulated standoff 50. The point of connection is the same as that from which low temperature line wire 60 was removed. Likewise, high temperature return wire 210 is connected to the other end of heater coil 40 at standoff 50, from which low temperature return wire 70 was removed. Finally, high temperature ground wire 220 is connected to chassis ground terminal 90 at the point where low temperature ground wire 80 was removed. The other ends of the three conducting elements, high temperature line wire 200, high temperature return wire 210, and high temperature ground wire 220 are connected to the three available terminals provided by appliance line socket 300, which is secured to the distal end 275 of thermally conductive threaded tube 270 by upper socket wire clamp 280, lower socket wire clamp 290, and clamp screws 295.

To complete the retrofit operation, the conducting elements of low temperature appliance cord 100 which have previously been disconnected from curling iron heating station 10 are connected to appliance line plug 310. That is, low temperature line wire 60, low temperature return wire 70, and low temperature ground wire 80 are connected to the proper terminals of appliance line plug 310 so as to maintain the same electrical circuit path with the internal circuitry elements of curling iron heating station 10 as existed before the retrofit operation began. This connection is effected by mating appliance line plug 310 to appliance line socket 300 after the retrofit operation is complete. At this point, only high temperature components exist within base 20 of curling iron heating station 10 and the low temperature components (low temperature appliance cord 100 and its internal conducting elements) are all now located outside the base 20.

Figure 4:
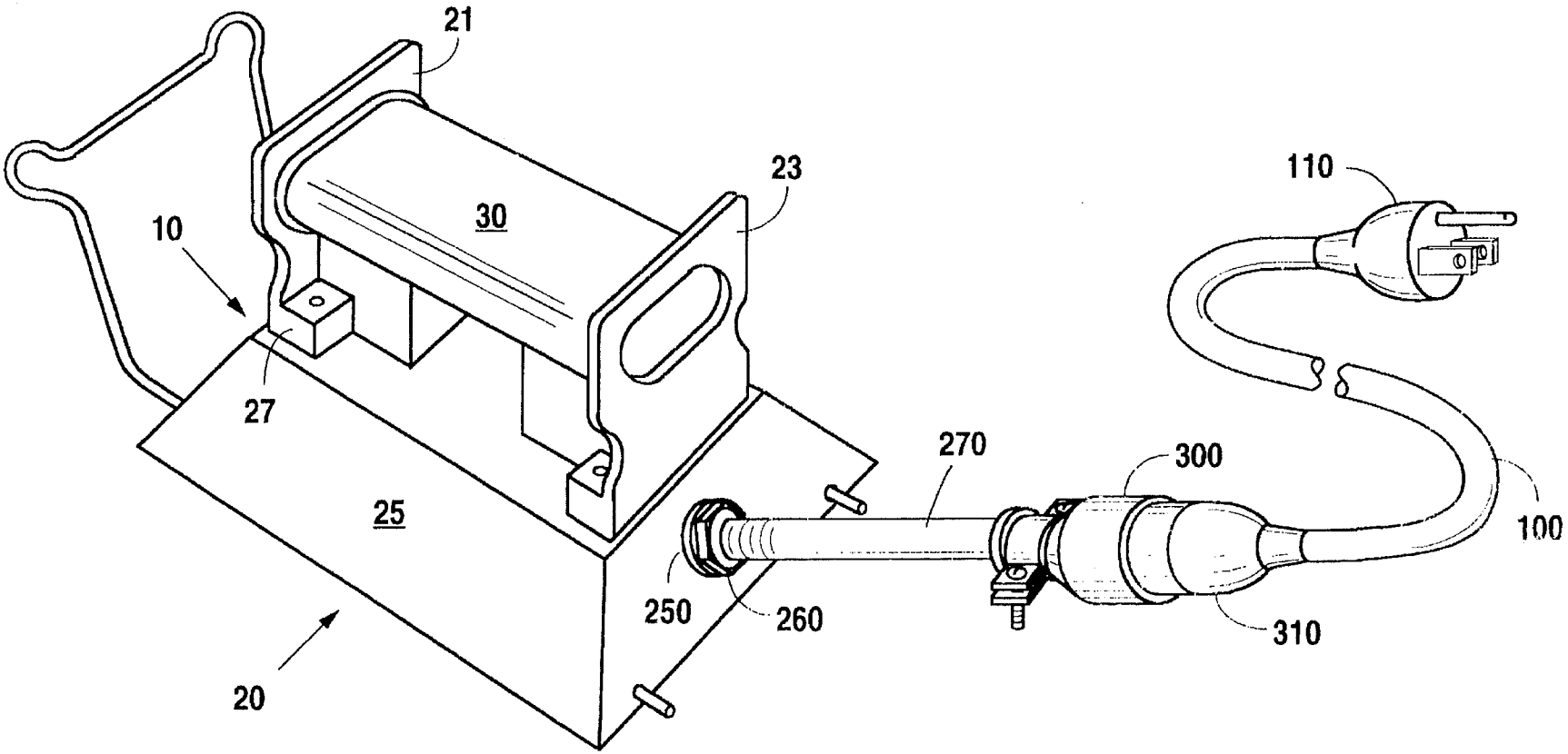
FIG. 4 is a perspective view of the preferred embodiment; a prior art curling iron heating station to which the retrofit kit has been applied.

The result can be seen in FIG. 4. It is also readily apparent from FIG. 4 that thermally conductive threaded tube 270, supported by outer lock washer 250 and outer nut 260, acts to draw additional heat out of base 20 for radiation into the environment, due to the metal-to-metal contact where thermally conductive threaded tube 270 intersects and engages base 20.

All of the separate components necessarily a part of the present inventive kit may be readily obtained and are well known to those skilled in the art. For ready reference, the following table is provided.

| ELEMENT # | ELEMENT NAME | GENERIC NAME | MANUFACTURER | PART # |
|---|---|---|---|---|
| 200 | High temperature line wire | Conductor | Belden | 83030 |
| 210 | High temperature return wire | Conductor | Belden | 83030 |
| 220 | High temperature ground wire | Conductor | Belden | 83030 |
| 230 | Inner nut | Hex nut | SPC Technology | NH8-6 |
| 260 | Outer nut | Hex nut | SPC Technology | NH8-6 |
| 240 | Inner lock washer | Internal tooth lock washer | SPC Technology | WLI-024-044-SC |
| 250 | Outer lock washer | Internal took lock washer | SPC Technology | WLI-024-044-SC |
| 270 | Thermally conductive threaded tube | Externally threaded pipe .375 IN. OD. | ??? | ??? |
| 280 | Upper socket wire clamp | 15A, 125 VAC grounding socket | Hubbell | 4729C |
| 290 | Lower socket wire clamp | 15A, 125 VAC grounding socket | Hubbell | 4729C |
| 295 | Clamp screw | 15A, 125 VAC grounding socket | Hubbell | 4729C |
| 300 | Appliance line socket | 15A, 125 VAC grounding socket | Hubbell | 4729C |
| 310 | Appliance line plug | 15A, 125 VAC connector plug | Hubbell | 4729C |

Equivalent items may be freely used; the specific parts delineated above should not be understood to limit the intention. For example, an in-line on/off switch may be installed into the low temperature appliance cord during the retrofit operation. Likewise, various materials may be used (such as high temperature plastics or composites) to retrofit the curling iron heating station. It is the unique combination and arrangement of these separate components with an existing station which result in the improved unit service life of the station.

Although the invention has been described with reference to specific embodiments, this description is not meant to be construed in a limited sense. Various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention.

I claim:

1. An improved curling iron heating station comprising:

a base supporting a heating coil, said base having a housing with an interior, an exterior, and an opening communicating therebetween, said heating coil having a first end and a second end, said first end of said heating coil and said second end of said heating coil located within said interior of said base;

a high temperature line wire with a first end and a second end, said first end of said high temperature line wire connected to said first end of said heating coil;

a high temperature return wire with a first end and a second end, said first end of said high temperature return wire connected to said second end of said heating coil;

a high temperature ground wire with a first end and a second end, said first end of said high temperature ground wire connected to said base at a point on said interior of said base;

a thermally conductive threaded tube having a proximal end and a distal end, said proximal end of said threaded tube extending through said opening in said housing, said proximal end of said threaded tube firstly engaged with and supported by an inner lockwasher and an inner hex nut applied to said threaded tube at a point proximate to said opening and said interior of said base, said proximal end of said threaded tube secondly engaged with and supported by an outer lockwasher and an outer hex nut applied to said threaded tube at a point proximate to said opening and said exterior of said base, said first and second engagement providing for thermal conductivity between said base and said threaded tube; and a three-conductor appliance socket having a neck clamping means, a line terminal, a return terminal, and a ground terminal, said second ends of said high temperature line wire, said high temperature return wire, and said high temperature ground wire passing from said interior of said base, into said proximal end of said threaded tube, out of said distal end of said threaded tube, into said exterior of said base, and through said neck clamping means, said second end of said high temperature line wire connected to said line terminal of said three-conductor appliance socket, said second end of said high temperature return wire connected to said return terminal of said three-conductor appliance socket, and said second end of said high temperature ground wire connected to said ground terminal of said three-conductor appliance socket, and said neck clamping means fixedly attaching said three-conductor appliance socket to said distal end of said threaded tube.

2. The apparatus of claim 1, further comprising a three-conductor appliance plug electrically connected by a cable means to a three conductor wall plug, said three-conductor appliance plug engaged electrically with said three-conductor appliance socket.

3. The apparatus of claim 2, further comprising an electrical on-off switch, said on-off switch connected to said cable means at a point between said three-conductor appliance plug and said three-conductor wall plug.

4. A kit for retrofitting a curling iron heating station, said station having a base supporting a heating coil, said base having a housing with an interior, an exterior, and an opening communicating therebetween, said heating coil having a first end and a second end, said first end of said heating coil and said second end of said heating coil located within said interior of said base, said kit comprising:

a high temperature line wire with a first end and a second end, said first end of said high temperature line wire for attachment to said first end of said heating coil;

a high temperature return wire with a first end and a second end, said first end of said high temperature return wire for attachment to said second end of said heating coil;

a high temperature ground wire with a first end and a second end, said first end of said high temperature ground wire for attachment to said base at a point on said interior of said base;

a thermally conductive threaded tube having a proximal end and a distal end, said proximal end of said threaded tube for extension through said opening in said base, said proximal end of said threaded tube for engagement with and support by appropriate nuts at a point around said opening and said interior of said base, a three-conductor appliance socket having a neck clamping means, a line terminal, a return terminal, and a ground terminal, said second ends of said high temperature line wire, said high temperature return wire, and said high temperature ground wire for passing from said interior of said base, into said proximal end of said threaded tube, out of said distal end of said threaded tube, into said exterior of said base, and through said neck clamping means, said second end of said high temperature line wire for connection to said line terminal of said three-conductor appliance socket, said second end of said high temperature return wire for connection to said return terminal of said three-conductor appliance socket, and said second end of said high temperature ground wire for connection to said ground terminal of said three-conductor appliance socket, and said neck clamping means for fixedly engaging said three-conductor appliance socket with said distal end of said threaded tube.

5. The apparatus of claim 4, further comprising a three-conductor appliance plug for electrical connection by a cable means to a three conductor wall plug, said three-conductor appliance plug mating electrically with said three-conductor appliance socket.

6. The apparatus of claim 5, further comprising an electrical on-off switch, said on-off switch for electrical connection to said cable means at a point between said three-conductor appliance plug and said three-conductor wall plug.

7. A method to retrofit the low-temperature wiring of a curling iron heating station, said curling iron heating station having a base supporting a heating coil, said base having an interior, an exterior, and an opening communicating therebetween, said heating coil having a first end and a second end, said first end of said heating coil and said second end of said heating coil located within said interior of said base, comprising the steps of:

disconnecting an end of a low-temperature line wire from said first end of said heating coil, disconnecting an end of a low-temperature return wire from said second end of said heating coil, disconnecting an end of a low-temperature ground wire from said base of said curling iron heating station, removing said ends of said low-temperature line wire, said low-temperature return wire, and said low-temperature ground wire through said opening of said base, inserting a thermally conductive threaded tube into said opening, said threaded tube having a proximal end and a distal end, threadably securing said proximal end of said threaded tube to said base so as to provide thermally conductive attachment between said tube and said base;

connecting a first end of a high-temperature line wire to said first end of said heating coil, connecting a first end of a high-temperature return wire to said second end of said heating coil, connecting a first end of a high-temperature ground wire to said base of said curling iron heating station, passing said high-temperature wires through said hollow threaded tube, connecting a second end of said high-temperature line wire to a line terminal of a three-conductor appliance socket, connecting a second end of said high-temperature return wire to a return terminal of said three-conductor appliance socket, connecting a second end of said high-temperature ground wire to a ground terminal of said three-conductor appliance socket, and clamping said three-conductor appliance socket onto said distal end of said thermally conductive threaded tube.

8. The method of claim 7, further comprising the steps of:

connecting said end of a said low-temperature line wire to a line terminal of a three-conductor appliance plug, connecting said end of said low-temperature return wire to a return terminal of said three-conductor appliance plug, connecting said end of said low-temperature ground wire to a ground terminal of said three-conductor appliance socket, and engaging said three-conductor appliance socket to said three-conductor appliance plug.

* * * * *